US009236644B2

(12) United States Patent
Czajkowski

(10) Patent No.: US 9,236,644 B2
(45) Date of Patent: Jan. 12, 2016

(54) PROGRAMMABLE MICROWAVE INTEGRATED CIRCUIT

(75) Inventor: David R. Czajkowski, Encinitas, CA (US)

(73) Assignee: SPACE MICRO INC., San Diego, CA (US)

( * ) Notice: Subject to any disclaimer, the term of this patent is extended or adjusted under 35 U.S.C. 154(b) by 0 days.

(21) Appl. No.: 12/660,144

(22) Filed: Feb. 19, 2010

(65) Prior Publication Data

US 2010/0231321 A1 Sep. 16, 2010

Related U.S. Application Data

(60) Provisional application No. 61/208,117, filed on Feb. 20, 2009.

(51) Int. Cl.
*H01P 1/15* (2006.01)

(52) U.S. Cl.
CPC ..... *H01P 1/15* (2013.01)

(58) Field of Classification Search
CPC ..... H04B 2001/40
USPC ..... 455/428, 13.3, 78, 83, 191.3
See application file for complete search history.

(56) References Cited

U.S. PATENT DOCUMENTS 6,441,783 B1 * 8/2002 Dean ..... 342/372
6,489,843 B1 * 12/2002 Nishijima et al. ..... 330/51
6,545,563 B1 * 4/2003 Smith ..... 333/103
6,584,304 B1 * 6/2003 Thomsen et al. ..... 455/188.1
6,884,950 B1 * 4/2005 Nicholson et al. ..... 200/181
6,944,437 B2 * 9/2005 Yang et al. ..... 455/323
2002/0151281 A1 * 10/2002 Izadpanah et al. ..... 455/83
2006/0017525 A1 * 1/2006 Goyette ..... 333/205
2007/0054628 A1 * 3/2007 Rowe et al. ..... 455/78
2007/0190994 A1 * 8/2007 Sakai et al. ..... 455/418
2008/0299913 A1 * 12/2008 Han et al. ..... 455/83
2009/0160430 A1 * 6/2009 Brown et al. ..... 324/76.23
2009/0233562 A1 * 9/2009 Kim et al. ..... 455/115.1
2009/0253384 A1 * 10/2009 Gorbachov ..... 455/83
2010/0297961 A1 * 11/2010 Chien ..... 455/84
2011/0013677 A1 * 1/2011 Ibrahim et al. ..... 375/219

* cited by examiner

*Primary Examiner* — Wen Huang
(74) *Attorney, Agent, or Firm* — Continuum Law; Robert P. Cogan

(57) ABSTRACT

In an integrated circuit a microwave signal is routed through a selected signal path. Routing is accomplished by switching to determine the signal path. Control signals are applied remotely. The microwave integrated circuit is programmable by virtue of the ability to command selection of a signal path. The signal path is chosen to include or avoid selected "RF functional elements," i.e., components through which radio frequency signals may be routed. RF functional elements may include, for example, amplifiers, mixers, attenuators, and phase shifters. Aspects of programmability in the integrated circuit include the provision of the functional circuit elements for selectable connection in signal paths, the switching and interconnect technologies used to switch and connect between them, and the arrangement of the functional circuit elements in relationship to each other.

26 Claims, 8 Drawing Sheets

PROGRAMMABLE MICROWAVE INTEGRATED CIRCUIT

CROSS-REFERENCE TO RELATED APPLICATIONS

This application claims priority from provisional application Ser. No. 61/208,117, entitled "Field Programmable Microwave Array," filed on Feb. 20, 2009. The contents of this provisional application are fully incorporated herein by reference.

BACKGROUND OF THE INVENTION

1. Field of the Invention

The present subject matter relates to a multifunctional microwave programmable integrated circuit or other semiconductor circuit for processing and translating microwave signals.

2. Background

Microwave processing circuits are now embodied in integrated circuits and circuit board devices. One application of growing importance is software defined radio (SDR). Among the many applications of SDR is in orbiting satellites. Space borne backend signal processors are limited by a priori system definition and RF hardware. Microwave circuits in orbit are not reconfigurable. Separate circuits must be provided for radar or communications functionality. Modulation bandwidths are essentially fixed. Different applications may utilize modulation bandwidths of anywhere from KHz to GHz. Another significant parameter is center frequency.

Deploying an apparatus with a wide range of capabilities may be expensive due to the need to use different systems to achieve different functionalities. Alternatively, providing a wide range of capabilities may simply be impossible due to space limitation, power constraints, or impracticality of isolating adjacent circuit boards from each other in a particular apparatus.

Since microwave devices are essentially dedicated, devices cannot be mass-produced to spread non-recurring costs but can be spread over a high number of devices as can be done with field programmable gate arrays (FPGAs) or Field Programmable Analog Arrays (FPAAs). Mass production keeps the per-unit cost and therefore the price, lower while allowing the user to configure the devices by field programming so that the needs and requirements of a particular application may be addressed. Additional benefits of field programmable IC include reconfigurability to allow the same IC as two different functions in a deployed circuit by reprogramming. Programmability aids in the development of circuits, when compared to fixed ICs, by allowing a shorter redesign cycle time. This occurs because the field programmable unit can usually be reprogrammed in very short time, such as milliseconds to an hour. Building a system on a chip integrated circuit (SOC IC) nominally takes weeks to months.

Field programmability exists at this time in ways that address some applications. With the advent of the Field Programmable Gate Array (FPGA) and Field Programmable Analog Array (FPAA), hardware reconfigurability has become an achievable goal in many digital and analog system designs.

U.S. Pat. No. 4,870,302, "Configurable electric circuit having configurable logic elements and configurable interconnects," addresses the needs of digital functions and circuit applications. FPGAs take advantage of the fact that many digital logic functional circuits may be resolved into some combination of a limited set of logic gates (such as NAND and NOR gates), memory elements (such as flip-flops) and other digital circuit elements. Although FPGAs can be configured to perform many functions, they are limited in that the overhead required to provide the programmability, which is implemented by the "switches" contained within the IC or SOC, limits the signal and speed performance.

U.S. Pat. No. 4,642,487, "Special interconnect for configurable logic array," examines the types of switches used and the number of switches connected to each signal route that determines the extent and type of this limitation. Digital FPGAs available today such as Xilinx® static random access memory (SRAM) FPGAs, Actel anti-fuse FPGAs or Actel® flash/EEPROM FPGAs (as examples) use switch types, interconnect topologies and interconnect materials and structures which effectively limit these devices so that they cannot process and route signals with a frequency greater than 400 MHz. This is due to the delay time and nonlinearity of the switches themselves, the number of switches tied to each signal routing line, the signal loss in the routing and impedance mismatch between consecutive functional blocks, routing lines and switches. The switches employed by today's FPGA manufacturers are not suitable for processing signals in the range of 1 GHz to 100 GHz. Even if the logic element circuits themselves can be manufactured to perform operations on signals at these speeds, the configurable switching fabric still places an upper bound on the frequency of signals that can be routed between them to much lower than 1 GHz.

U.S. Pat. No. 5,680,070, entitled "Programmable analog array and method for configuring the same," addresses, to some extent, programmability in analog circuits. These too cannot process higher frequency signals. They cannot do so because the basic functional building blocks are not optimized for RF signal processing, the switches used have too much parasitic delay or signal distortion, the placing of functional blocks and routing methodology between them is not optimized or impedance matching is not performed between consecutive elements on the IC.

If a designer wishes to have the benefits of programmability for higher frequency signals, no reasonable solution exists. Equivalent circuits in the high RF, Microwave, and Millimeter-Wave frequency regime have not been developed. The primary challenge in providing programmability for higher speed signals, has been that impedance matching (between circuit elements or between switches) is paramount to achieving high performance. In order to provide correct matching, the required hardware and circuitry ends up being too large to be really used within such ICs. This, by definition, makes circuit hardware realizations physically large and fixed, and therefore not really appropriate for use within an IC. Furthermore, the signal switching and routing problem is magnified by the fact that interconnect circuits must maintain sufficient transmission line characteristics to avoid inter-component reflection problems, and most MMIC processes offer only limited interconnect layering capability.

Development of any new integrated circuit, whether it is intended for digital, analog, or radio frequency applications is an extremely capital-intensive process. It takes a great deal of time, money, and resources to take a concept through the entire design, development, pilot manufacturing and testing processes so that a final, stable, and manufacturable IC results. The nature of such design efforts normally results in an IC that is suited for a very particular situation or application. Its functionality is fixed and locked in at the earliest stages of the design process, and the IC is designed, manufactured and tested to meet that particular function or set of functions. This allows for a high number of these devices to be mass-produced and to eventually reduce the per-unit costs of the ICs down to a reasonable level. The economics of IC manufacturing are such that the non-recurring costs associated with the design and testing of the IC, and laying out of the various masks and tooling which are needed for the manufacturing of it, are very high compared to the per-unit costs associated with the production of each device. Therefore ICs tend to be manufactured with the intent of mass-production, so that the non-recurring costs may be amortized over the many individual units which are eventually made and sold. Additionally, IC designs are then manufactured using a fixed mask set, making the resulting IC also fixed.

The economic constraints within this IC design process result in two distinct phenomena when it comes to the realities of ICs manufacturing and availability: First, ICs are generally designed with some degree of a "widespread use" in mind. In this way, a high number of units may be manufactured and sold, allowing for the per-unit price to be set at reasonable levels (since there are so many units across which to spread the non-recurring costs). An IC that is designed for widespread use may not provide the required functionality for a particular application. Second, any application that might require the design and development of a more "application specific" IC, will have to bear the full burden of very high non-recurring costs across fewer units, causing the per-unit cost (and price) of each IC to be very high.

To resolve this dilemma, the configurable or "field programmable" device type has been developed. The concept of field programmability allows a more generic type of device to be designed and manufactured. This is done is by considering that most functions provided within a given IC (or SOC) are based upon separate "building blocks" or circuits (all on that given IC or SOC) that are then configured, interconnected and subsequently operate in a very particular manner. For example a given IC may be made up of hundreds, or thousands (or more) of separate small circuit elements, all of which are present on the IC, each configured and interconnected to provide the IC with its resultant manner of operation. On a conventional IC, the interconnection scheme is fixed and frozen as a part of the design and manufacturing process. In a field programmable device, this means of interconnection and configuration is not fixed, and to a great extent can be "programmed" using switches after the device is manufactured.

The IC is made with a set of discrete functional "building blocks" of circuitry within it, and these are configured so that their particular means of operation can still be set after the manufacturing is completed. Also, the interconnection of these circuits (again, all within the IC itself) is not fixed, but instead is designed so that the actual connections may (to some extent) also be "programmed" using the field programmable switch. In this way, an IC can be made with all of these building blocks available, and with various means of interconnection provided. After manufacturing, the end user (in the "field") can "program" the device through means of various electrical signals being applied to it so that the exact, resultant configuration of how the circuit elements within the IC operate, and how they are connected to each other, can be done according to the needs of the particular application.

This allows for devices such as this to be mass-produced so that the non-recurring costs can be spread over a high number of devices (which keeps the per-unit cost and therefore the price, lower) while allowing the user to configure the devices (by field programming) so that the needs and requirements of a particular application may be addressed. There are other additional, non-cost benefits of field programmable ICs, which include: reconfiguring the same IC as two different functions in a deployed circuit by reprogramming the IC during the application and aids in the development of circuits, when compared to fixed ICs, by allowing a shorter redesign cycle time. This occurs because the field programmable unit can simply be reprogrammed (normally in very short time, such as milliseconds to an hour) as compared to building an SOC IC (normally taking weeks to months).

Field programmability exists at this time in ways that address some applications. With the advent of the FPGA and FPAA, hardware reconfigurability has become an achievable goal in many digital and analog system designs. Development of an integrated circuit (IC) or system-on-a-chip (SOC) for processing signals in the radio frequency (RF), microwave, and millimeter-wave frequencies usually requires a design and manufacturing approach which warrants that each and every specific IC and SOC be developed with a very specific architecture and application in mind. The innovation described herein allows for the development of a device which can be used in such applications but which is configurable after manufacturing. In this manner, a device can be manufactured which has numerous functional blocks and capabilities built within, but yet whose exact configuration and interconnection of those functions and capabilities is not predetermined at the time of design and manufacture. The user(s) can program the device so that it operates and performs in the manner needed for any given application. Applications include: communication systems; radar systems; sensors; or any microwave subsystem that includes these standard functional components.

U.S. Pat. No. 4,870,302, "Configurable electric circuit having configurable logic elements and configurable interconnects," addresses the needs of digital functions and circuit applications. FPGAs take advantage of the fact that many digital logic functional circuits may be resolved into some combination of a limited set of logic gates (such as NAND and NOR gates), memory elements (such as flip-flops) and other digital circuit elements. Although FPGAs can be configured to perform many functions, they are limited in that the overhead required to provide the programmability, which is implemented by the "switches" contained within the IC or SOC, limits the signal and speed performance.

U.S. Pat. No. 4,642,487 demonstrates that the types of switches used and the number of switches connected to each signal route determines the extent and type of this limitation. Digital FPGAs available today such as Xilinx® static random access memory (SRAM) FPGAs, Actel® anti-fuse FPGAs or Actel flash/EEPROM FPGAs (as examples) use switch types, interconnect topologies and interconnect materials and structures which effectively limits these devices so that they cannot process and route signals with a frequency greater than 400 MHz. This is due to the delay time and nonlinearity of the switches themselves, the number of switches tied to each signal routing line, the signal loss in the routing and impedance mismatch between consecutive functional blocks, routing lines and switches. The switches employed by today's FPGA manufacturers are not suitable for processing signals in the range of 1 GHz to 100 GHz. Even if the logic element circuits themselves can be manufactured to perform operations on signals at these speeds, the configurable switching fabric still places an upper bound on the frequency of signals that can be routed between them to much lower than 1 GHz.

U.S. Pat. No. 5,680,070, "Programmable analog array and method for configuring the same," addresses, to some extent, programmability in analog circuits. These too cannot process higher frequency signals. They cannot do so because the basic functional building blocks are not optimized for RF signal processing, the switches used have too much parasitic delay or signal distortion, the placing of functional blocks and routing methodology between them is not optimized or impedance matching is not performed between consecutive elements on the IC.

U.S. Pat. No. 6,944,437 discloses a microwave circuit in which connections of certain elements may be changed. However, existing circuit paths may simply be turned on or off. There is no reconfigurability in the sense of creating signal paths that are new in comparison to a preexisting state. The degree of possible signal routing is limited.

If a designer wishes to have the benefits of programmability for higher frequency signals, no reasonable solution exists. Equivalent circuits in the high RF, Microwave, and Millimeter-Wave frequency regime have not been developed. The primary challenge in providing programmability for higher speed signals, has been that impedance matching (between circuit elements or between switches) is paramount to achieving high performance. In order to provide correct matching, the required hardware and circuitry ends up being too large to be really used within such ICs. This, by definition, makes circuit hardware realizations physically large and fixed, and therefore not really appropriate for use within an IC. Furthermore, the signal switching and routing problem is magnified by the fact that interconnect circuits must maintain sufficient transmission line characteristics to avoid inter-component reflection problems, and most MMIC processes offer only limited interconnect layering capability.

SUMMARY

In accordance with the present subject matter, and integrated circuit is provided, which supports multifunctional in-field programmability for microwave circuits. This apparatus will be called a Field Programmable Microwave Array (FPMA). Among features that characterize the present subject matter are the selection of functional elements within the array, the switching and interconnect technologies used to switch and connect between them, and the arrangement of functional circuit elements in relationship to each other.

Briefly stated in accordance with the present subject matter, an integrated circuit is provided in which microwave signals are selectively routed through a selected signal path. Routing is accomplished by switching to determine the signal path. Control signals may be applied remotely. The microwave integrated circuit is programmable by virtue of the ability to command selection of a signal path. It is field programmable as well as factory programmable. The signal path is chosen to include one or more selected "RF functional elements," i.e., components through which radio frequency signals may be routed. RF functional elements may include, for example, amplifiers, mixers, attenuators, and phase shifters.

Aspects of programmability in the integrated circuit include the provision of the functional circuit elements for selectable connection in signal paths, the switching and interconnect technologies used to switch and connect between them, and the arrangement of the functional circuit elements in relationship to each other.

The present subject matter provides "programmability" to ICs and SOCs that can operate at, manipulate, and create electrical signals that are in these high-frequency, e.g., RF, microwave, and millimeter-wave, bands. The present subject matter uses switch circuit designs for signal selection, complementary-transistor structures for bias control, and simple logic functions, multi-level metal interconnect technology for efficient signal routing, and large-scale microwave chip integration. These are all combined in a manner that results in an IC or SOC which provides the user with an "array" of functional building blocks, which are then configured and interconnected in whatever manner is appropriate for a given application. The result to the user may be viewed as a monolithic microwave integrated circuit (MMIC), that can be reconfigured for different functionality and/or parametric performance, which is particularly desired for an application.

Key aspects of Field Programmable Microwave Array (FPMA) include the selection of the functional circuit elements within the array, the switching and interconnect technologies used to switch and connect between them, and the arrangement of the functional circuit elements in relationship to each other. "Programmability" of the device comprises configuration of switches and where and how electrical signals are routed within the FPMA. The digital circuitry is exercised by applying signals to the IC which then switch and configure the internal components in the manner which a user needs for their application.

The present subject matter permits construction of advanced software defined radio (SDR) RF front-end sections that are as flexible as their software back-ends, allowing in-use or in-orbit reconfiguration of original bands and modulation types. This RF front-end provides a post-launch, in-orbit reconfigurable RF module. Such a module is capable of low frequency Hz to at least 150 GHz bandwidth. Benefits include vastly reduced shelf inventory of equipment addressing different RF requirements and permits ever-ready deployment capabilities using a single piece of equipment featuring this proposed RF front-end.

BRIEF DESCRIPTION OF THE DRAWINGS

The invention may be further understood by reference to the following description taken in connection with the following drawings.

DETAILED DESCRIPTION

Figure 1:
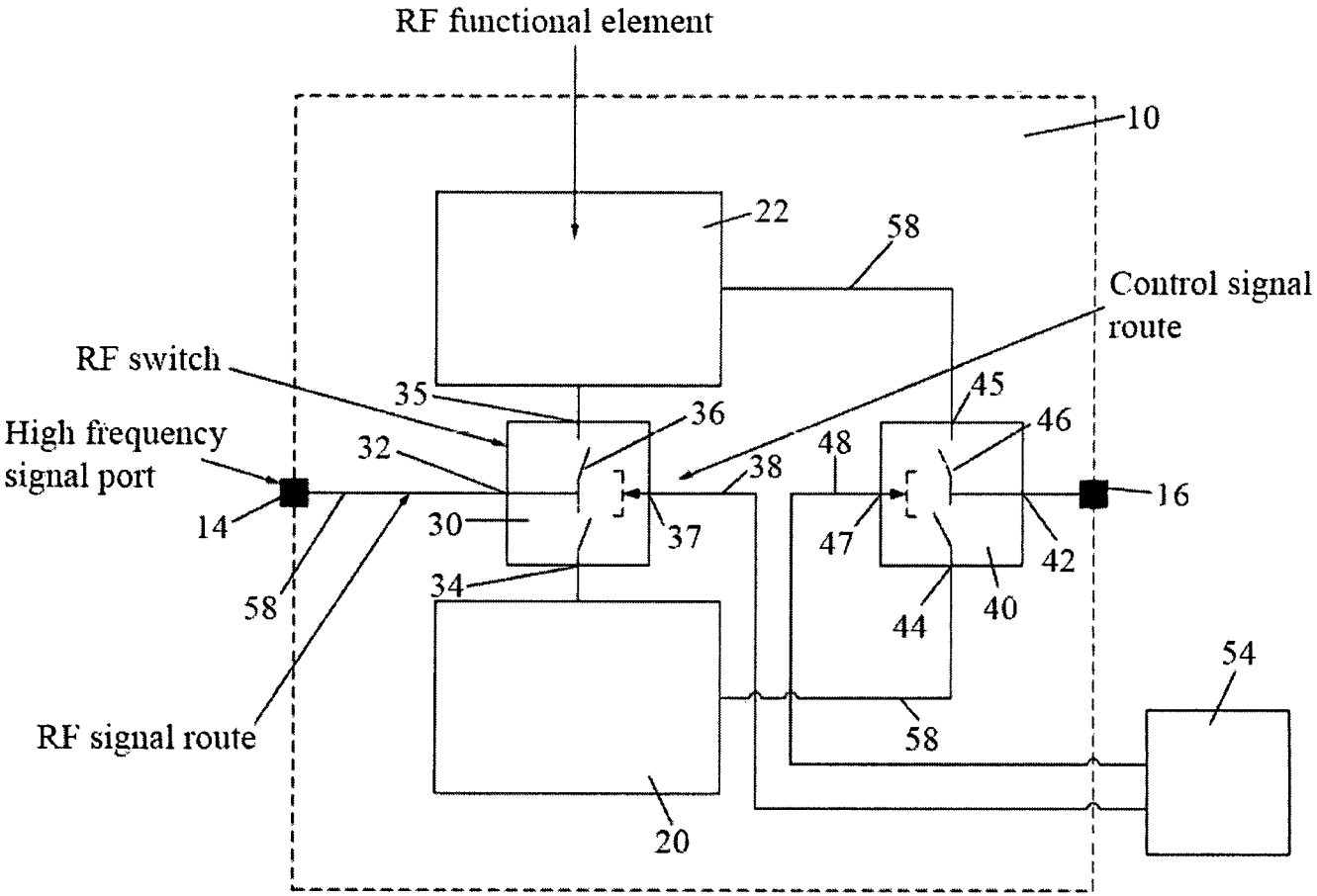
FIG. 1 is a block diagram of a programmable microwave array constructed in accordance with the present subject matter.

FIG. 1 is a block diagram of a programmable microwave array 1 constructed in accordance with the present subject matter. The programmable microwave array 1 processes and translates signals. "Translation" is used here to describe propagation as opposed to transformation. "Process" includes, but need not be limited to, performing the sorts of functions commonly performed on RF signals by RF functional elements. "RF functional elements" is used to describe modules which are included in RF signal paths to perform "processes." The RF functional elements which can be used within an FPMA may include, but are not limited to, items such as amplifiers; low noise amplifiers, medium power amplifiers, wideband distribution amplifiers, mixers, voltage controlled oscillators, attenuators, and phase shifters.

In order to connect these circuit elements, crossover routing of RF transmission lines must be available and a series of switch circuits must be used. The switches may comprise single-pole-double-throw (SPDT) switches. The configuration of these switch circuits, and where and how the electrical signals are routed within the FPMA, is what provides the "programmability" of the device. This control and programmability is provided by using digital control logic. The digital circuitry is exercised by applying signals to the IC which then switch and configure the internal components in the manner which the user needs for their application.

Crossover routing implies the transmission of multiple signals. The multiple signals may travel in orthogonal directions that are in close proximity without excessive cross coupling of the signals.

A substrate 10 has first signal port 14 and a second signal port 16. First and second RF functional elements 20 and 22 are provided for selective coupling between the first signal port 14 and the second signal port 16. First and second switches 30 and 40 are provided. The switches 30 and 40 provide for creation of signal paths rather than turning on and off permanently present signal paths.

The switch 30 has a series terminal 32 and first and second selectable terminals 34 and 35. A controllable switch 36 is operated by a control signal provided to a first control signal port 37. The control signal is provided over a control line 38. The switch 40 has a series terminal 42 and first and second selectable terminals 44 and 45. A controllable switch 46 is operated by a control signal provided to a first control signal port 47. The control signal is provided over a control line 48. The control signals may be provided from a control signal source 54. The control signal source 54 may comprise a receiver decoding signals transmitted from a remote location or may comprise a local control signal source.

Signal lines 58 are provided to interconnect components. Signal lines 58 may comprise, for example, runs in conductive layers of integration circuit chips or wires.

In one state, the operable connector 37 connects the terminal 32 to the terminal 34, and the operable connector 47 connects the terminal 42 to the terminal 44. In this state, the FPMA 1 is programmed to connect the first RF functional element 20 between the first and second RF ports 14 and 16. In another state, the operable connector 37 connects the terminal 32 to the terminal 35, and the operable connector 47 connects the terminal 42 to the terminal 45. In this state, the FPMA 1 is programmed to connect the second RF functional element 22 between the first and second RF ports 14 and 16. In one embodiment, the first and second RF functional elements 20 and 22 could be bandpass filters having first and second center frequencies. By programming the first or the second state, the FPMA may be configured to respond to a first or second band of frequencies.

This technique becomes more powerful when additional switches and sets of RF functional elements are utilized. Additional switches and RF functional elements may be utilized up to an "acceptable number" which will provide an "acceptable aggregate level of performance." The electrical performance characteristics of each of these elements are be designed to meet the requirements of high-frequency applications. Each component may introduce a degree of signal degradation. Signal degradation may be introduced by impedance mismatches, signal to noise ratio provided by a component, isolation or the lack thereof, distortion, excessive input frequency bandwidth, and many other effects. The levels of signal degradation are measurable. The acceptable aggregate level of performance is known since it is defined in apparatus specifications. An "adequate level of performance" is a definite parameter since measureable signal degradation can be compared to performance specifications.

The FPMA is intended to include a variety of functions that may be connected in an array of configurations. Two elements of the MMIC design are paramount for effective utilization of this functionality: 1) crossover routing of RF transmission lines; and 2) signal switching (SPOT). Crossover routing implies the transmission of multiple signals, perhaps in orthogonal directions, that are in close proximity without excessive cross-coupling of the signals. Most MMIC technologies now have at least three-metal-interconnect (SMI) capabilities. This means that coplanar-waveguide transmission lines may exist on separate layers, with a potential ground isolation layer between them. Hence, non-planar topologies may be realized in a single MMIC device. This is a huge advantage for complex reconfigurable architectures.

A key component to realizing these FPMAs is the incorporation of low-loss high-isolation RF switch circuits. MESFET devices are useful at lower frequency operation, but high-frequency performance is degraded. MEMS switches are just maturing to the point of being usable for the complex switching and signal-routing requirements.

Given this routing flexibility, single-pole double-throw (SPDT) switch circuits are required to route the signal to the functional blocks of interest. In fact, a large number of switches are required on chip to provide effective configurable capability without sacrificing RF performance.

Two main varieties of radio frequency switches are known as reflective switches and absorptive switches. The ideal choice of switch type depends on the application. Radio frequency switches, as with other types of electrical switches, are made in configurations including but not limited to single pole double throw, single pole triple throw, single pole sextuple throw and matrix or transfer type switches. Another important parameter of switch circuits for many other applications is switching speed. However, due to the static nature of the FPMA 1, a high switch speed is not required. Many different types of switches are known for the switching of radio frequency signals.

Figure 2:
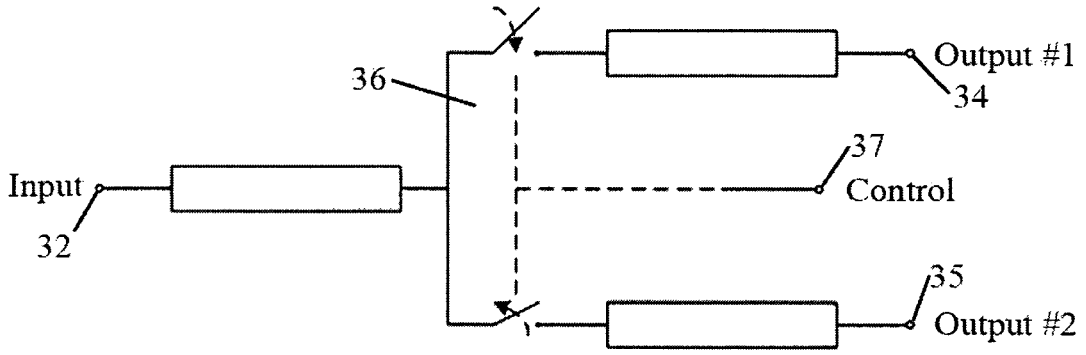
FIG. 2 is a block diagram of a reflective RF Switch Circuit.

FIG. 2 is a block diagram of a reflective RF Switch Circuit. The function of a reflective switch circuit is very similar to a standard relay. It exhibits low loss from the common port to the selected port and high isolation from the common port to the deselected port. The OFF-port impedance is generally either an open- or short-circuit, thus "reflecting" any incident signals. In the first state describe above, wherein the port 35 is disconnected from the port 32, the port 35 is the OFF-port. Often a shunt element is included in the OFF channel to improve isolation.

Figure 3:
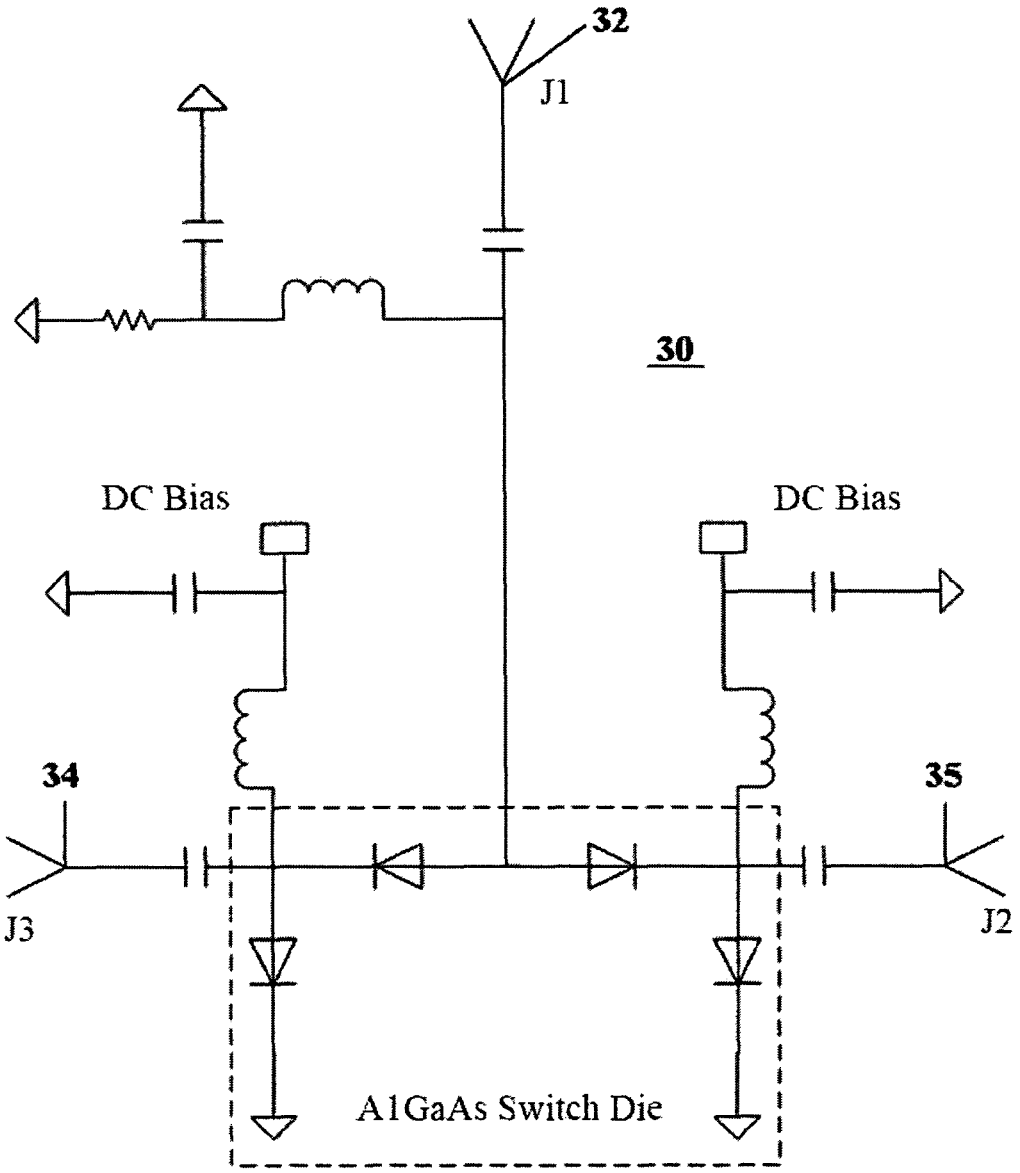
FIG. 3 is a schematic diagram of a reflective RF Switch Circuit used in one illustrative embodiment.

FIG. 3 is a schematic diagram of a reflective absorptive RF Switch Circuit used in one illustrative embodiment. A suitable reflective switch in one embodiment is the M/A-COM MA4AGSW2 produced by M/A-COM Inc., www.macom-.com.

Figure 4:
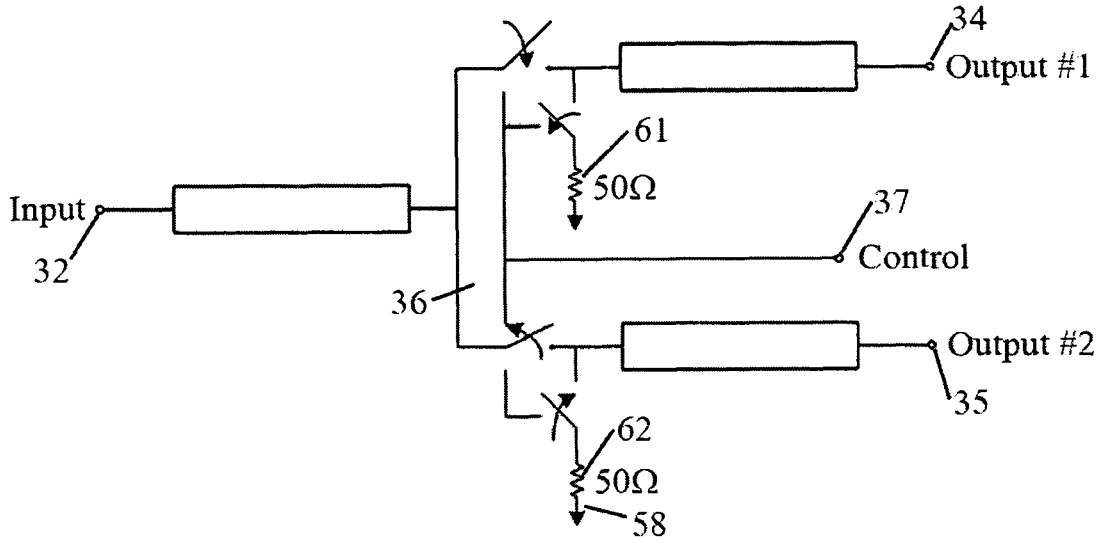
FIG. 4 is a block diagram of an absorptive RF Switch Circuit.

FIG. 4 is a block diagram of an RF Switch Circuit. In an absorptive switch, a switch resistance value is set with consideration of the characteristic impedance of the system's transmission lines, e.g., the signal lines 58. A nominal impedance is 50 ohms. An absorptive switch circuit "absorbs" any incident signals or a fixed portion of such signals. This is important for those applications in which circuit performance is dependent on the ON- and OFF-state impedance remaining constant. For instance, in an RF switch matrix application, coupling factors in adjacent paths may be directly affected by reflective loads in unselected channels. OFF-port impedances 61 and 62 are switchably connected to provide a resistance in series with a current OFF port, namely port 34 or port 35. The current OFF port has a resistive path to a reference level, e.g., ground. In the present embodiments, the OFF-port impedances 61 and 62 comprise resistors. However, reactances could be provided if needed.

Figure 5:
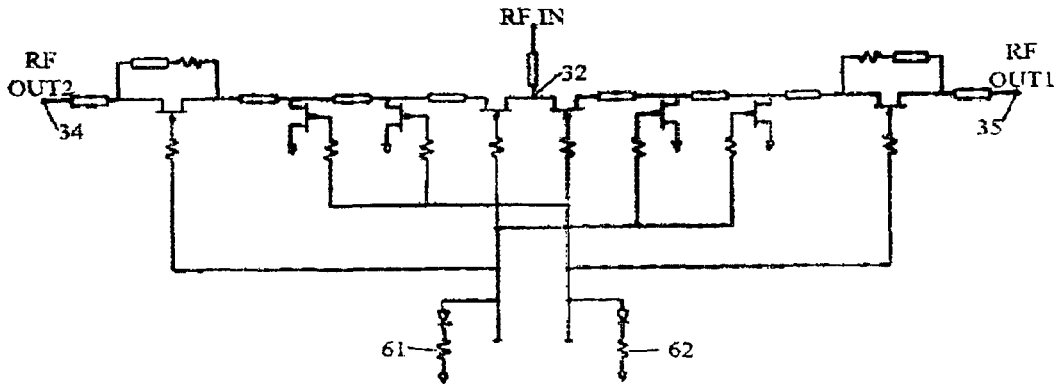
FIG. 5 is a schematic diagram of an absorptive RF Switch Circuit used in one illustrative embodiment.

FIG. 5 is a schematic diagram of an absorptive RF Switch Circuit used in one illustrative embodiment. The switches 30 and 40 may, but do not have to, comprise FET switches. FET switches provide for low power dissipation, simplified bias and interface designs, fast switching speeds, and monolithic integration of multiple functions on a chip. A suitable switch that has been used in one embodiment is the Agilent HMMC-2027 made by Agilent Technologies, www.agilent.com. This switch has been used on frequency ranges from DC to 26 GHz.

Figure 6:
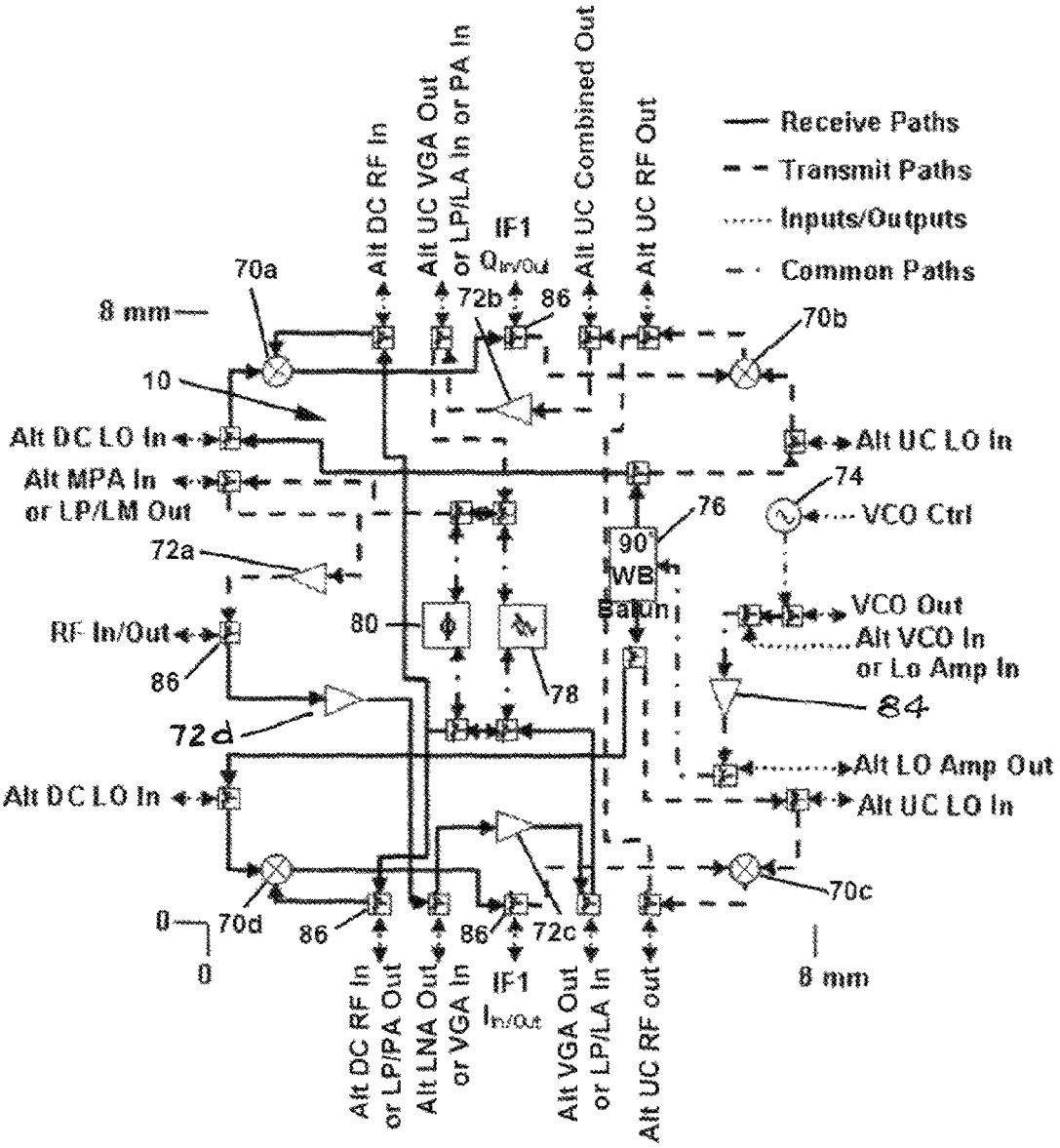
FIG. 6 illustrates the internal structure of one embodiment of a programmable microwave array.

FIG. 6 illustrates the internal structure of one embodiment of a programmable microwave array. The functional components are uni-directional, but the signal routing architecture supports chip bidirectional operation, based upon how the FPMA 1 is programmed. In the present illustration, the broadband RF chip of FIG. 6 supports operation from 4 GHz to 16 GHz.

This example broadband RF chip, FPMA 1, supports operation on signals with frequencies ranging from 4- to 16-GHz. The multiple RF functional elements included in the present example include four distributed mixers 70 *a-d*, four distributed amplifiers 72 *a-d*, a Voltage Controlled Oscillator (VCO) 74, a 90-degree balun 76, a linear attenuator 78, a linear phase shifter 80, a medium power amplifier 82; a low-noise amplifier 84, and multiple RF switch circuits 86.

By implementing the design on complementary technology substrates (such as E/D MESFET), the logic and bias structures may be incorporated on the same IC as the microwave functions. The programmable functions are set up via a 3-line serial programming string that fill a serial shift register. Those functions not being used are de-activated, thus conserving DC power.

Input/output signal routing is illustrated in FIG. 6 as the dotted bidirectional arrows. Receive paths are in solid lines, transmit paths are in dashed lines, and common paths are in cross-hatched lines. The architecture is appropriately segmented to make the FPMA 1 work as a programmable bidirectional upconverter/downconverter. However, access to individual components is also provided. As shown in FIG. 7, a complete image-rejection downconverter signal routing is shown as the solid and mixed dot and dash lines. A complete image-rejection upconverter routing is presented as the dashed and mixed dot and dash lines. Since the input/output lines are coincident, the single chip may be operated in either mode, based on the programming paradigm.

Figure 7A:
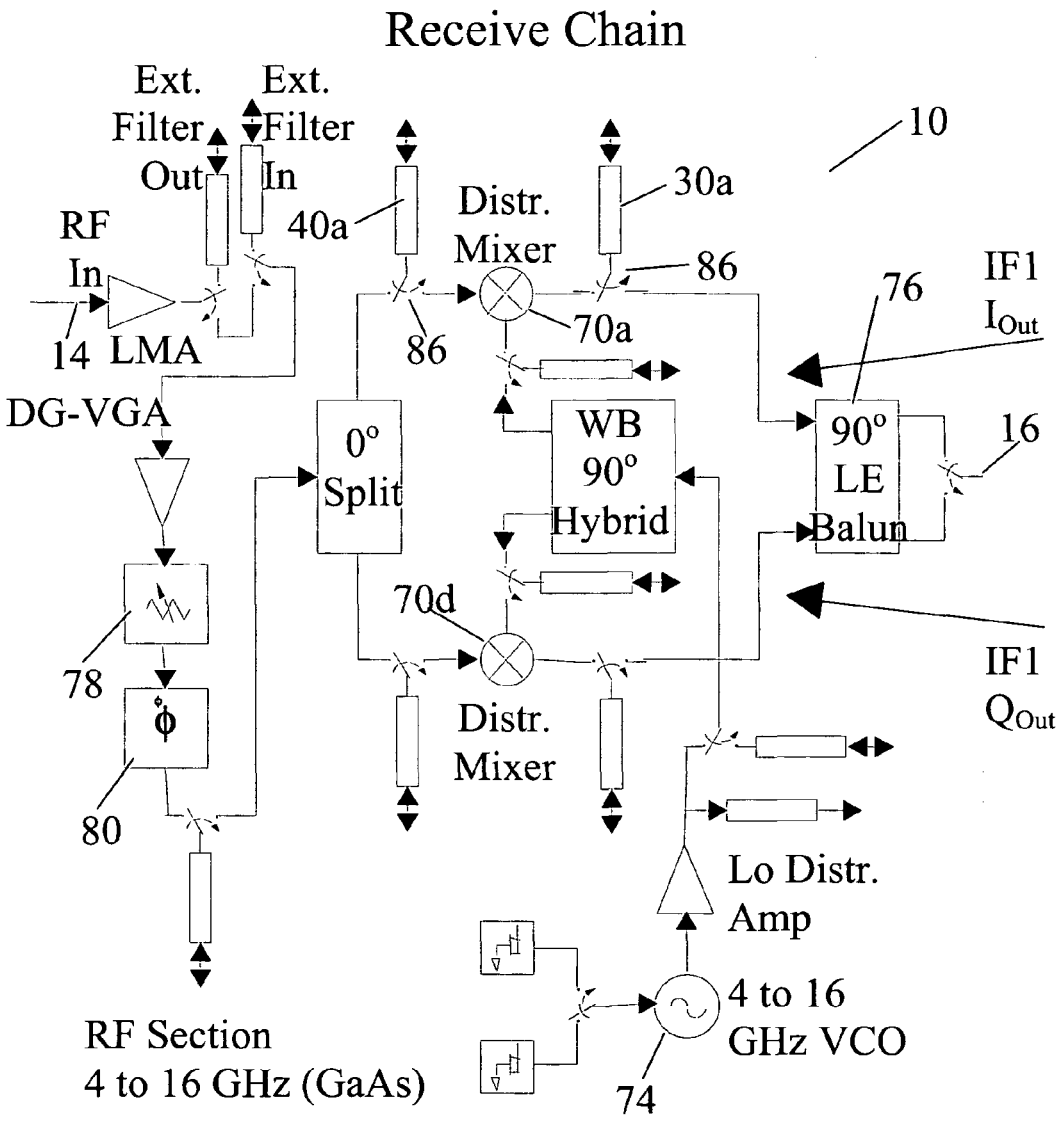
FIG. 7 consists of FIG. 7A and FIG. 7B, each respectively illustrating the programmable microwave array of FIG. 6 programmed for one of two different applications.
Figure 7B:
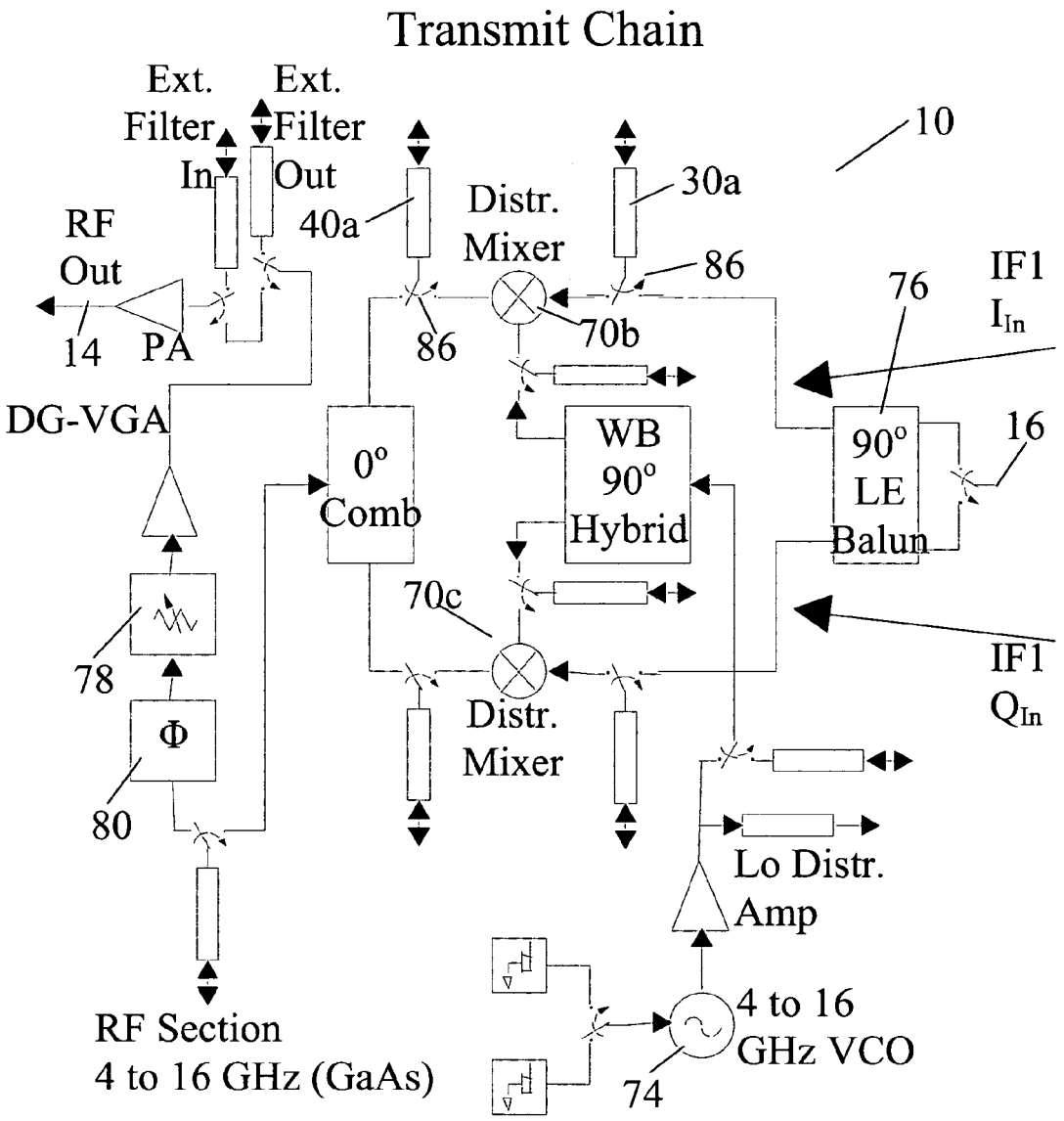

FIG. 7 consists of FIG. 7A and FIG. 7B, each respectively illustrating the programmable microwave array of FIG. 6 programmed for one of two different applications. A plurality of switches is provided to achieve programmability. In FIG. 7A, RF functional elements described with respect to FIG. 6 are connected in a receive chain. In FIG. 7B, the same RF functional elements are connected in a transmit chain.

An extrapolation of this architecture supports dual-conversion operation and, in general, microwave subsystems that are "morphable". For example, a communication transceiver subsystem may morph (via programming commands only) into a radar subsystem by judicious selection and integration of multiple FPMAs. FIG. 5 shows functionally the results of how the example FPMA can be programmed. The same FPMA, using different programming, can interconnect a series of circuit elements (in this example) to provide a Receiver function, or a Transmit Function. The resultant signal path is shown in FIG. 5.

The FPMA 1 is distinguished from standard Systems-on-a-Chip (SoC). Existing SOCs are designed to optimize point solutions to specific applications. As such, they are not generally applicable to a wide array of applications. Nor are SOCs typically designed to process wide bandwidth signals. The innovation here is to provide a variety of functional components that may be selected (or not selected), based on an external programming paradigm. The FPMA 1 permits construction of microwave subsystems that are "reconfigurable on-the-fly" or reconfigurable on the test bench.

The FPMA 1 may be combined with a companion switch matrix chip, which connects to the standard FPMA IC. Coplanar waveguide transitions route the points around the outside of the FPMA chip to the companion switch matrix chip. The switch matrix IC realizes a complex multi-channel crosspoint switch function that emulates the multiple crossover routing functions of a standard FPGA. The switches themselves may be realized using either FET or MEMS technology.

The specific architecture will certainly evolve to provide greater flexibility. As circuit density increases, larger numbers of functional components will be included—similar to what has happened in the world of digital FPGAs. In addition to morphable subsystems, the programmable nature of the FPMA offers the system designer greater flexibility to prototype arid evaluate new subsystem architectures in significantly shorter time frames.

What is claimed is:

1. A field programmable microwave array in an integrated circuit, said field programmable microwave array comprising:

a monolithically integrated circuit;

at least a first signal path and a second signal path in said monolithically integrated circuit, each signal path selectively connectable between a first RF port and a second RF port;

each said signal path containing a plurality of RF operating elements, at least one said RF operating element in each signal path comprising an active element;

a plurality of RF switches in one said signal path, each said RF switch being associated with only one said RF operating element, each RF switch selectively coupling or not coupling one said RF operating element in a respective signal path, each set of RF operating elements comprising a different set of components;

the RF switches being selectively connectable in a collective state to connect one set of RF operating elements to define one respective signal path between said first RF port and said second RF port in a first state and to define a second signal path between said first RF port and said second RF port in a second state;

each signal path defining a corresponding respective functionality.

2. A field programmable microwave array according to claim 1 wherein switching the RF switches from a first state to a second state morphs the integrated circuit from one apparatus into another.

3. A field programmable microwave array according to claim 2 wherein said sets of RF operating elements include common members.

4. A field programmable microwave array according to claim 3 wherein the corresponding respective functionality defines an apparatus and wherein the first or second RF port selectively comprises an input port or an output port in correspondence with the apparatus defined by a current collective state of the RF switches.

5. A field programmable microwave array according to claim 3 wherein each said RF switch comprises an OFF port in a signal path at which a respective RF operating element is disconnected from a respective signal path and an ON port at which the respective RF operating element is connected in one said signal path.

6. A field programmable microwave array according to claim 5 wherein each said RF switch comprises a single pole switch.

7. A field programmable microwave array according to claim 5 wherein an OFF port further comprises a matching impedance for said input port wherein said RF switch is absorptive.

8. A field programmable microwave array according to claim 5 wherein an OFF port is coupled to an open circuit and wherein said RF switch is reflective.

9. A field programmable microwave array according to claim 5 wherein each said RF switch comprises a single pole double throw switch.

10. A field programmable microwave array according to claim 3 comprising a radiation hardened package.

11. A field programmable microwave array according to claim 1 wherein sets of RF operating elements contain common members.

12. A field programmable microwave array according to claim 11 wherein one said corresponding functionality comprises a receiver and wherein another said functionality comprises a transmitter.

13. A field programmable microwave array according to claim 12 comprising said first signal path and said second signal path wherein:

said RF operating elements comprise first, second, third, fourth, and fifth distributed amplifiers, first, second, third, and fourth distributed mixers, a voltage controlled oscillator, a 90-degree balun, a linear attenuator, and a linear phase shifter;

wherein included in said first signal path and said second signal path are said 90-degree balun, said linear attenuator, said linear phase shifter, and said fifth amplifier;

wherein included in said first signal path are said third and said fourth distributed amplifiers, and said first and said fourth distributed mixers;

wherein included in said second signal path are said first and said second distributed amplifiers, and said second and said third distributed mixers;

wherein the first signal path has an input from the first RF port and is coupled to said RF input to convert incoming RF signals and to normalize the RF signals by connecting the RF signals through said linear attenuator and said linear phase shifter in a first direction, and providing said RF signals to an RF section in the transceiver;

wherein the second signal path provides an RF output to the first RF port and couples said RF signals through said linear attenuator and said linear phase shifter in a second direction, the second set of signal paths converts a signal received from the RF section and couples the signal to the RF output; and each RF switch being connected to a control signal to determine its state.

14. A morphable subsystem in a field programmable microwave array, said subsystem comprising:

a monolithic integrated circuit;

in said monolithic integrated circuit, a first set having a plurality of RF operating elements defining a first signal path comprising a first apparatus and a second set having a plurality of RF operating elements defining a second signal path comprising a second apparatus, each set of RF operating elements comprising at least one active element;

a plurality of RF switches, each said RF switch being connected to switch a respective RF operating element independently of switching of another RF operating element and being selectively connectable in a first state to define a first signal path comprising said first set of RF operating elements, said RF switches being selectively connectable in a second state, to define a second signal path comprising said second set of RF operating elements;

said RF switches each comprising a control terminal coupled to a source of control signals for operating said RF switches in a preselected configuration, each said control signal being selected in correspondence to a first state for embodying the first apparatus or a second state for embodying the second apparatus.

15. A morphable subsystem in a field programmable microwave array according to claim 14 wherein said first and said second sets of RF operating elements include common members.

16. A morphable subsystem in a field programmable microwave array according to claim 15 wherein each said RF switch comprises an OFF port in a signal path at which a respective RF operating element is disconnected from a signal path and an ON port at which the respective RF operating element is connected in the signal path.

17. A morphable subsystem in a field programmable microwave array according to claim 16 wherein each said RF switch comprises a single pole switch.

18. A morphable subsystem in a field programmable microwave array according to claim 16 wherein an OFF port further comprises a matching impedance for said input port and wherein said RF switch is absorptive.

19. A morphable subsystem in a field programmable microwave array according to claim 16 wherein an OFF port is coupled to an open circuit and wherein said RF switch is reflective.

20. A morphable subsystem in a field programmable microwave array according to claim 16 further comprising a radiation hardened package housing said field programmable monolithic integrated circuit.

21. A field programmable microwave array in an integrated circuit, said field programmable microwave array comprising:

a monolithically integrated circuit;

a group of ports connectable as separate pairs of ports;

at least a first signal path and a second signal path in said monolithically integrated circuit, each signal path selectively connectable between a pair of ports in said group of ports;

each said signal path comprising a respective set of components comprising a plurality of RF operating elements;

each set of RF operating elements containing at least one active RF operating element;

a plurality of RF switches in one said signal path, each RF switch selectively coupling or not coupling only one said RF operating element in a respective signal path;

the RF switches being selectively connectable in a collective state to connect one set of RF operating elements to define a first signal path between a said pair of ports in a first state and to connect another set of RF operating elements to define a second signal path between one said pair of ports in a second state;

each signal path defining a corresponding respective functionality.

22. A field programmable microwave array according to claim 21 wherein one said signal path comprises first and second terminals to which a component remote from the monolithically integrated circuit may be connected.

23. A field programmable microwave array according to claim 21 wherein pairs of ports are connectable to provide a plurality of input ports and a plurality of output ports.

24. A field programmable microwave array according to claim 21 wherein at least one said signal path comprises at least one terminal coupled to a first RF operating element and a second RF operating element for combination or splitting of RF signals.

25. A field programmable microwave array according to claim 21 wherein a signal path comprises connections to allow splitting of RF signals and combining of RF signals from a plurality of RF operating elements.

26. A field programmable microwave array according to claim 21 wherein at least one signal path comprises a loop.

* * * * *